United States Patent [19]

Lenders et al.

[11] 4,274,603

[45] Jun. 23, 1981

[54] MACHINE FOR WINDING WIRE COILS

[75] Inventors: Wilhelmus L. L. Lenders; Martinus J. van Hirtum, both of Eindhoven, Netherlands

[73] Assignee: U.S. Philips Corporation, New York, N.Y.

[21] Appl. No.: 1,118

[22] Filed: Jan. 5, 1979

[30] Foreign Application Priority Data

Jan. 6, 1978 [NL] Netherlands ..... 7800156

[51] Int. Cl.[3] ..... H01F 41/00; H01F 41/04; B65H 57/28

[52] U.S. Cl. ..... 242/7.14; 242/25 R

[58] Field of Search ..... 242/7.14, 7.17, 7.18, 242/7.09, 7.03, 25

[56] References Cited

U.S. PATENT DOCUMENTS

| | | | |
|---|---|---|---|
| 3,106,351 | 10/1963 | Fulton | 242/7.14 |
| 4,020,996 | 5/1977 | Deeg | 242/7.03 |
| 4,157,165 | 6/1979 | Bierman et al. | 242/7.14 |

*Primary Examiner*—Billy S. Taylor

*Attorney, Agent, or Firm*—William J. Streeter; Bernard Franzblau

[57] ABSTRACT

In a machine for winding a wire coil on a stationary spool by means of a wire guide which moves around the spool and also traverses the spool in the axial direction thereof, the wire guide is formed by an end portion of a tubular winding finger which is supported intermediate its ends in a bearing which, in the operation of the machine, performs an orbital movement such that the wire guide is moved around the spool. At the end remote from the wire guide the winding finger is pivotally coupled to three actuating elements which are displaceable by controllable drives in different directions such that the winding finger is displaceable in any direction by the actuating elements. The latter feature enables the wire guide to be so manipulated that the wire can be wrapped about anchoring pins on the spool while the spool is on the machine.

12 Claims, 2 Drawing Figures

MACHINE FOR WINDING WIRE COILS

Figure 1:
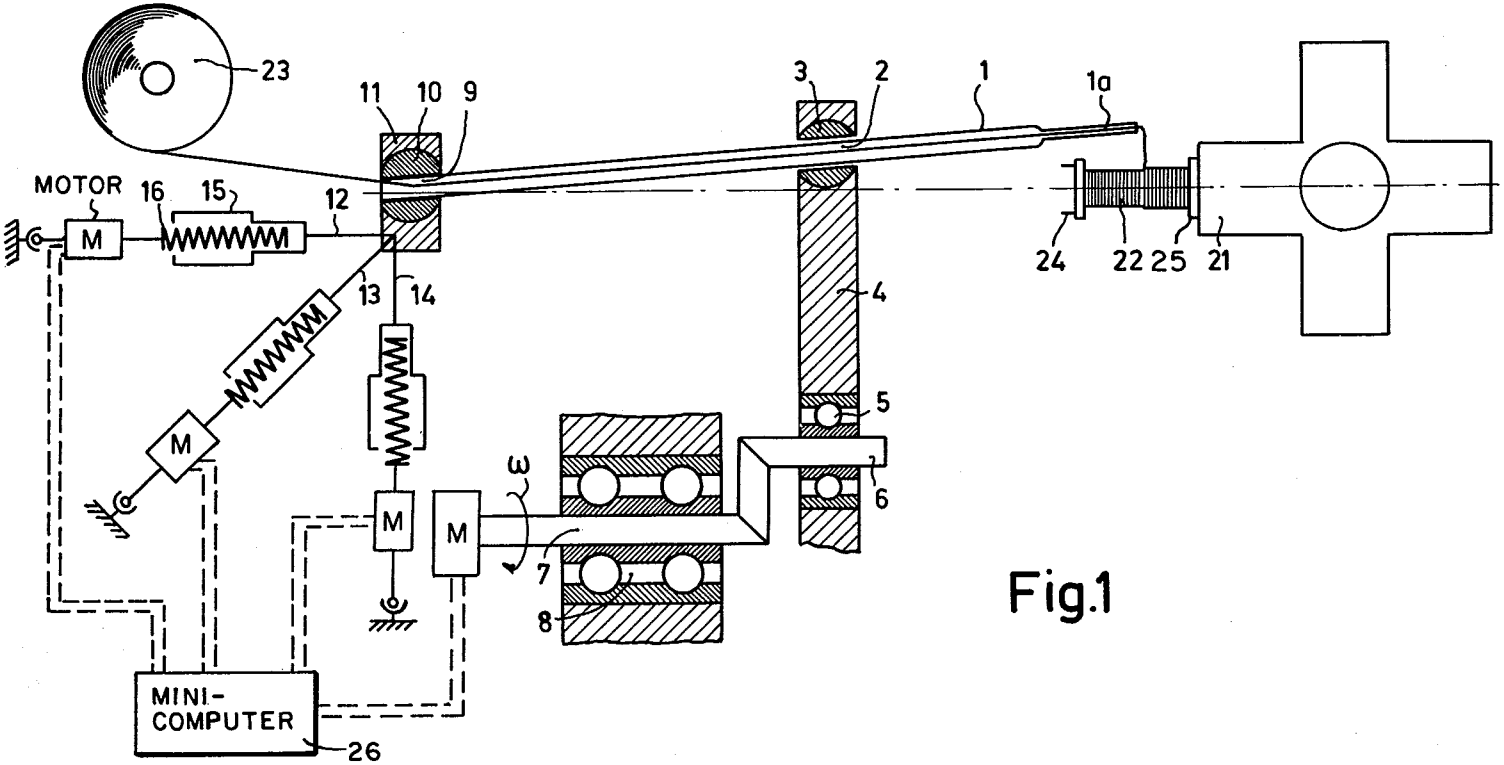

The invention relates to a machine for winding a wire coil, comprising a spool holder for stationarily supporting a spool on which the coil is to be wound, and a wire guide for guiding a wire from a wire supply onto the spool supported by the holder, the wire guide being movable around the spool and being capable of traversing the spool in a direction parallel to the axis thereof.

During the winding of a coil on a stationary spool by means of a wire guide which moves around the spool, it is customary for the actual wire guide, in the form of a wheel or tube, to be secured to a wheel or disk which is secured to a hollow shaft. This hollow shaft is arranged approximately coaxially with the spool. A coil-winding machine of this kind is described in German Auslegeschrift No. 1,907,922. In order to obtain evenly wound coils on machines of this kind, the wire guide is moved, together with the wheel or the disk to which it is, connected in the axial direction. Sometimes the spool itself is moved in the axial direction.

These known coil-winding machines have a drawback in that the beginning and end of the wire of the coil cannot be anchored to the spool while the spool and coil are still in the winding position on the machine.

According to the invention there is provided a machine for winding a wire coil, comprising a spool holder for stationarily supporting a spool on which the coil is to be wound, and a wire guide for guiding a wire from a wire supply onto the spool supported by the holder. The wire guide is movable around the spool and is capable of traversing the spool in a direction parallel the axis thereof. The wire guide is formed by an end portion of a tubular winding finger which is supported at a first point spaced from this end portion in a bearing which is capable of performing an orbital movement about an axis which coincides with the axis of the spool supported by the holder, the path of said movement lying in a plane which extends transversely of said axis. The winding finger is pivotally coupled at a second point which is spaced further from said end portion of the winding finger than the first point to three actuating elements which are displaceable by associated controllable drive devices in different directions such that the pivotal coupling is displaceable in any direction by the actuating elements.

The wire guide formed by the end portion of the winding finger can thus perform all movements required for winding a coil, namely, a movement around the spool and a traversing movement in the axial direction of the spool. Additionally, the wire guide can be manipulated by movement of the winding finger by means of the three actuating elements, to wrap the beginning of the wire around anchoring pins provided on the machine and on the spool, and also to wrap the end of the wire around a further anchoring pin provided on the spool.

According to one embodiment of the invention, the bearing by which the winding finger is supported is connected to a crank mechanism having a variable eccentricity, and means are provided for driving this mechanism at variable speed. In this embodiment the path of the orbital movement of the wire guide around the spool can be adjusted towards or away from the spool and the speed of this movement can be varied.

The controllable drive of each of the three actuating elements may comprise a rotatable lead screw which is coupled to a controllable motor and which cooperates with a non-rotatable nut coupled to the respective actuating element. The motor may be formed by an electric or hydraulic motor.

The nut of the screw-and-nut drive of each actuating element may comprise a housing which is connected to the actuating element and which surrounds the respective lead screw and contains a first set of rollers which are rotatable about fixed axes in the housing and are spaced about the axis of the lead screw and which are arranged in rolling contact with one flank of the thread of the screw so as to transmit thrust from the screw to the housing in one axial direction, and a second set of rollers which are rotatable about fixed axes in the housing and are spaced about the axis of the lead screw and which are arranged in rolling contact with the other flank of the thread of the screw so as to transmit thrust from the screw to the housing in the opposite axial direction. The two sets of rollers are spaced from one another in the direction of the axis of the lead screw, and spring means are arranged in the housing to press the rollers against the respective flanks of the thread of the lead screw.

The two sets of rollers may be mounted one set in each of two rings which are coaxially arranged in said housing and which surround the lead screw, the rollers of each set being spaced evenly around the inner surface of the respective ring, and each ring being held against rotation in the housing but being capable of limited axial movement therein and being acted upon in an axial direction by said spring means.

Preferably, the angle between the flanks of the thread on the lead screw is at least 90°. This has the advantage that the rolling contact between each set of rollers and the respective flank is not obstructed by the other flank, so that no restrictions are imposed as regards the diameter of the rollers.

Figure 2:
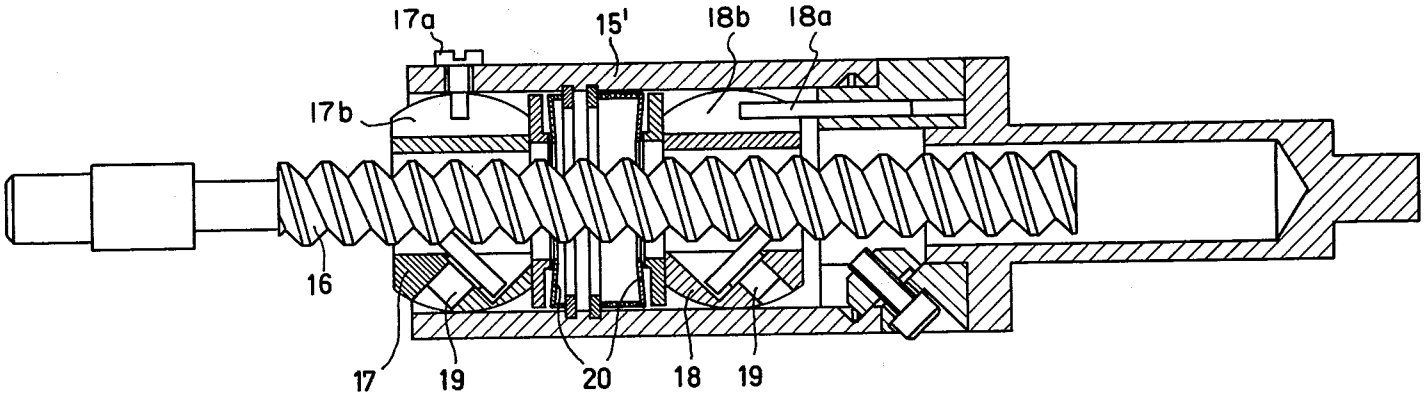

An embodiment of the invention will now be described in detail with reference to the accompanying drawings, in which:

FIG. 1 is a diagrammatic side elevation of a coil-winding machine according to an embodiment of the invention, and FIG. 2 is an axial sectional view of a screw-and-nut drive of one of the actuating elements of the machine shown in FIG. 1.

The reference numeral 1 in FIG. 1 denotes a tubular winding finger, an end portion 1*a* of which forms a wire guide. At an area 2 intermediate its ends the winding finger is slidable axially in a bearing formed by a ball 3 which is rotatable in a socket in a plate 4 so that the finger 1 can pivot in all directions. The plate 4 is journalled by means of a ball bearing 5 on a crank pin 6 connected to a crank shaft 7 which is journalled in a fixed bearing 8. The crank shaft 7 is coupled to a controllable electric motor so that the crank mechanism 6,7 can be driven at a variable speed.

As the crank shaft 7 rotates, the plate 4 moves with the crank pin 6, and means which are not shown in the drawing but which may be of any convenient known form are provided for guiding the plate 4 so that the ball 3 performs an orbital, preferably circular, movement about an axis A which is parallel to and spaced from the axis of the crank shaft 7. The path of this orbital movement lies in a plane perpendicular to the axis A. If desired, several winding fingers can be supported in the plate 4 in a similar manner to the winding finger 1 so that a number of coils can be wound simultaneously.

At its end 9 remote from the wire guide 1*a* the winding finger 1 is secured in a ball 10 which is rotatable in a socket in a body 11. The body 11 is pivotally coupled to three axially displaceable actuating rods 12, 13 and 14 which are arranged at angles to one another such that together they are capable of displacing the body 11 in any direction. Some licence has been taken in the drawing in that the rod 13, which should be shown in end view in FIG. 1, has been drawn in side view so that it can be illustrated more clearly. Each of the actuating rods 12, 13 and 14, at its end remote from the body 11, is connected to a non-rotatable nut 15 which cooperates with a rotatable lead screw 16. Each of the lead screws 16 is provided with an associated controllable electric motor and is coupled in turn by means of a universal joint to a fixed machine part. The drives of the actuating rods may alternatively be formed by pneumatic or hydraulic linear motors.

The lead screw 16 and the nut 15 may be constructed as shown in FIG. 2. In this construction the nut comprises two rings 17 and 18 which are coaxially arranged in a cylindrical housing 15′ and each of which contains a set of at least two and preferably three or more rollers 19 (only one is shown in each ring) distributed evenly around the inner surface of the ring. The rollers in the ring 17 are arranged in rolling contact with one flank of the thread of the lead screw 16 so as to transmit thrust from the screw to the housing 15′ in one axial direction, and the rollers in the ring 18 are arranged in rolling contact with the other flank of the thread of the lead screw so as to transmit thrust from the screw to the housing in the opposite axial direction. The rings 17 and 18 are held against rotation in the housing 15′ by members 17*a* 18*a* respectively which are fixed in the walls of the housing and which engage in axially extending grooves 17*b* and 18*b* respectively in the rings 17 and 18. This allows the rings to be urged axially away from each other by cup springs 20 so that the rollers 19 are always held in contact with the flanks of the thread of the lead screw 16, thus ensuring that the transmission is free from play. The rollers 19 preferably have the construction of rolling bearings, that is to say they each comprise inner and outer races with rolling bodies such as balls between the races.

The angle between the flanks of the thread of the lead screw is preferably at least 90° so that the rolling contact between each of the rollers 19 and the respective flank is not impeded by the other flank.

The machine shown in FIG. 1 further comprises a holder 21 on which can be secured a spool 25 on which a coil is to be wound. The holder is arranged to support the spool in a position such that the axis of the spool coincides with the axis about which the winding finger 1 is rotated by the crank mechanism 6, 7 and plate 4. The holder 21 may be constructed as a turret which comprises, for example four supports for the spools and which can be turned through four positions. In one position the coil can be wound, as shown at 22, whereas in the other positions, for example, a new spool can be fitted and a completed coil removed.

In the operation of the above machine, wire is fed from a supply reel 23 through the winding finger 1 onto the spool 25. The orbital movement of the finger required for winding the coil around the spool is achieved by means of the crank mechanism 6,7 and the plate 4, and the traversing movement of the winding finger parallel to the axis of the spool for positioning successive turns of the wire along the spool is obtained by means of the actuating rod 12 and associated nut 15 and lead screw 16. When the desired number of turns has been deposited on the spool 25, the orbital movement of the winding finger is stopped when the finger is in a given position, and the winding finger is then manipulated by combined movement of the actuating rods 12,13,14 to wrap the end of the wire around anchoring pins 24 on the spool 25. A similar manipulation of the winding finger is employed to wrap the beginning of the wire around further anchoring pins (not shown) on the spool 25 and on the machine prior to the winding of the coil 22.

The motors which drive the lead screw 16, and also the crank mechanism 6, 7 can be controlled by a minicomputer 26 in accordance with a desired programme.

What is claimed is:

1. A machine for winding a wire coil, comprising a spool holder for stationarily supporting a spool on which the coil is to be wound, a wire supply, a wire guide for guiding a wire from the wire supply onto a spool supported by the holder, means for mounting the wire guide so that it is movable around the spool and is capable of traversing the spool in a direction parallel the axis thereof, the wire guide comprising a tubular winding finger having an end portion for delivering the wire to the spool, said mounting means comprising, means for supporting the tubular winding finger at a first point spaced from said end portion in a bearing which is capable of performing an orbital movement about an axis which coincides with the axis of the spool supported by the holder, the path of said orbital movement lying in a plane which extends transversely of said axis, and means pivotally coupling the winding finger to three actuating elements at a second point which is spaced further from said end portion of the winding finger than the first point, said three actuating elements being displaceable in different directions by associated controllable drive devices such that the pivotal coupling is displaceable in any direction by the combined operation of the actuating elements.

2. A coil-winding machine as claimed in claim 1, wherein said bearing is coupled to a crank mechanism, and wherein means are provided for driving said mechanism at a variable speed.

3. A coil-winding machine as claimed in claim 1 or 2, wherein the drive device of each of the three actuating elements comprises a rotatable lead screw coupled to a controllable motor and which cooperates with a non-rotatable nut which is coupled to the respective actuating element.

4. A coil-winding machine as claimed in claim 3, wherein the nut of the screw-and-nut drive device of each actuating element comprises a housing which is coupled to the actuating element and which surrounds the respective lead screw and contains first and second axially spaced apart sets of rollers, the first set of rollers being rotatable about fixed axes in the housing and being spaced about the axis of the lead screw and arranged in rolling contact with one flank of the thread of the screw so as to transmit thrust from the screw to the housing in one axial direction, the second set of rollers being rotatable about fixed axes in the housing and being spaced about the axis of the lead screw and arranged in rolling contact with the other flank of the thread of the screw so as to transmit thrust from the screw to the housing in the opposite axial direction, and spring means arranged to press the rollers against the respective flanks of the thread of the lead screw.

5. A coil-winding machine as claimed in claim 4, wherein the first and second sets of rollers are mounted in first and second rings, respectively, coaxially arranged in said housing and which surround the lead screw, the rollers of each set being spaced evenly around the inner surface of the respective ring, and each ring being held against rotation in the housing but being capable of limited axial movement therein and being acted upon in an axial direction by said spring means.

6. A coil-winding machine as claimed in claim 4, wherein the angle between the flanks of the thread on the lead screw is at least 90°.

7. A coil-winding machine as claimed in claim 5 wherein the angle between the flanks of the thread on the lead screw is at least 90°.

8. Apparatus for winding a wire coil on a spool comprising, a spool holder for supporting a spool on which the wire coil is to be wound, a wire supply, a wire guide comprising a tubular winding finger having a free end for guiding a wire from the wire supply onto a spool supported by the spool holder, means for mounting the winding finger so that it is movable in a direction parallel to the spool axis and in an orbit around said axis, said mounting means comprising, means for supporting the tubular winding finger at a first point spaced from said free end in a bearing which is rotatable in an orbit about an axis coincident with the spool axis and with the spool supported on the spool holder, the path of said orbit lying in a plane transverse of said axis, and a body pivotally supporting the winding finger at a second point spaced further from said free end of the winding finger than said first point, and actuating means coupled to said body for moving the body in three mutually perpendicular directions so that the body is displaceable in any direction by the actuating means.

9. Apparatus as claimed in claim 8 wherein the spool holder is adapted to support the spool in a non-rotatable manner and further comprising drive means coupled to said actuating means.

10. Apparatus as claimed in claims 8 or 9 wherein said bearing comprises a ball rotatable in a socket provided in a second body and wherein the ball includes a passage in which the winding finger is supported.

11. Apparatus as claimed in claim 8 wherein the actuating means comprises three mutually perpendicular rods coupled at one end to said body and to three respective non-rotatable nuts, and three rotatable lead screws which cooperate individually with said three nuts to produce linear movement of said three rods in said three mutually perpendicular directions.

12. Apparatus as claimed in claim 9 wherein the actuating means comprises three mutually perpendicular rods coupled at one end to said body and to three respective non-rotatable nuts, and three rotatable lead screws which cooperate individually with said three nuts to produce linear movement of said three rods in said three mutually perpendicular directions, and said drive means comprises three motors individually coupled to rotatably drive said three lead screws.

* * * * *